US012742602B2

(12) United States Patent
Chen

(10) Patent No.: US 12,742,602 B2
(45) Date of Patent: Sep. 22, 2026

(54) COSMETOLOGY INSTRUMENT

(71) Applicant: Xiamen Ubest Electronic Technology Co., Ltd., Xiamen (CN)

(72) Inventor: Kunlin Chen, Xiamen (CN)

(73) Assignee: Xiamen Ubest Electronic Technology Co., Ltd., Xiamen (CN)

( * ) Notice: Subject to any disclaimer, the term of this patent is extended or adjusted under 35 U.S.C. 154(b) by 180 days.

(21) Appl. No.: 18/536,863

(22) Filed: Dec. 12, 2023

(65) Prior Publication Data

US 2025/0164197 A1 May 22, 2025

(30) Foreign Application Priority Data

Nov. 17, 2023 (CN) ..... 202323116264.7

(51) Int. Cl.
*F28F 9/26* (2006.01)

(52) U.S. Cl.
CPC ..... *F28F 9/26* (2013.01)

(58) Field of Classification Search
CPC ..... A61H 2201/0285
USPC ..... 165/80.3
See application file for complete search history.

(56) References Cited

U.S. PATENT DOCUMENTS 3,207,159 A * 9/1965 Kazuma ..... A61B 18/08 62/3.62
3,971,229 A * 7/1976 Privas ..... A61F 7/00 62/3.62
4,308,013 A * 12/1981 Major ..... A61C 19/04 219/241
5,097,828 A * 3/1992 Deutsch ..... A61F 7/007 604/113
5,209,227 A * 5/1993 Deutsch ..... F25B 21/04 607/104
6,679,908 B2 * 1/2004 Shimizu ..... A61F 7/02 607/109
7,679,908 B2 * 3/2010 Yeh ..... G06F 1/181 165/104.34
7,713,295 B2 * 5/2010 Ahn ..... A61F 7/007 607/108
9,610,039 B2 * 4/2017 Golosarsky ..... A61B 5/4827
10,512,319 B2 * 12/2019 Yamazaki ..... A45D 44/00
11,358,167 B2 * 6/2022 Bouix ..... B05B 12/004
2008/0300529 A1 * 12/2008 Reinstein ..... A61F 7/007 604/20
2016/0089537 A1 * 3/2016 Yamazaki ..... A61B 18/14 601/2
2019/0350752 A1 * 11/2019 Aguiar ..... A61F 7/02
(Continued)

*Primary Examiner* — Devon Lane
(74) *Attorney, Agent, or Firm* — Westbridge IP LLC

(57) ABSTRACT

A cosmetology instrument includes a housing, a heat dissipation assembly, a semiconductor chilling and heating plate, and an electronic component. The housing includes a first housing and a second housing, the electronic component and the heat dissipation assembly are disposed in the first housing, the semiconductor chilling and heating plate is disposed in the second housing, and the first housing is connected with the second housing through the heat dissipation assembly; a circumferential air outlet is formed by a gap between the first housing and the second housing, and the first housing is provided with an air inlet; and an air channel is formed between the electronic component and an inner wall of the housing.

8 Claims, 5 Drawing Sheets

(56) References Cited

U.S. PATENT DOCUMENTS

| | | | | |
|---|---|---|---|---|
| 2022/0192745 | A1* | 6/2022 | Pan | A61B 18/18 |
| 2024/0108537 | A1* | 4/2024 | Meisinger | A61H 23/0254 |

* cited by examiner

COSMETOLOGY INSTRUMENT

CROSS-REFERENCE TO RELATED APPLICATIONS

This application claims priority to Chinese Patent Application No. 202323116264.7, filed on Nov. 17, 2023, the content of which is incorporated herein by reference in its entirety.

TECHNICAL FIELD

The present disclosure relates to the field of medical cosmetology equipment, and more particularly relates to a cosmetology instrument.

BACKGROUND

At present, some portable or hand-held cosmetology instruments on the market achieve cold and hot compress functions through a thermoelectric effect of semiconductor chilling and heating plates. Such products are often applied to cold compress for the face to achieve the effects of improving facial edema and tightening skin and pores, and hot compress to achieve the effects of promoting blood circulation and accelerating the absorption of skin care products.

Generally, the cosmetology instruments have a poor heat dissipation effect inside the bodies after long-term use, thereby affecting the operation of the cosmetology instruments and failing to achieve the expected cosmetology effects. An air inlet and an air outlet for heat dissipation designed in the body of the product are usually formed in a single side surface of a shell, and uniform heat exchange of a heat dissipation assembly inside the body is limited by air output on a single side; and in view of the hand-held situation, the air inlet designed in the side surface of a part of the bodies may be blocked by a hand for holding, such that the heat dissipation effect is not good, and the experience of a user is affected.

SUMMARY

The technical problem to be solved by the present disclosure is to provide a cosmetology instrument which avoids the limitation of single-side air output on the heat dissipation effect of a heat dissipation assembly, improves the heat dissipation effect and ensures the product performance.

In order to solve the above technical problem, the technical solution adopted by the present disclosure is as follows: a cosmetology instrument includes a housing, a heat dissipation assembly, a semiconductor chilling and heating plate, and an electronic component. The housing includes a first housing and a second housing, the electronic component and the heat dissipation assembly are disposed in the first housing, the semiconductor chilling and heating plate is disposed in the second housing, and the first housing is connected with the second housing through the heat dissipation assembly; a circumferential air outlet is formed by a gap between the first housing and the second housing, and the first housing is provided with an air inlet; and an air channel communicated with the circumferential air outlet and the air inlet is formed between the electronic component and an inner wall of the housing.

Further, the heat dissipation assembly includes a heat dissipation fan and a heat dissipation member, one end of the heat dissipation member is connected with the semiconductor chilling and heating plate, the heat dissipation fan is disposed on one side, away from the semiconductor chilling and heating plate, of the heat dissipation member, and the heat dissipation fan is connected with the electronic component.

Further, a guide cambered surface obliquely facing the circumferential air outlet is disposed at a position on the heat dissipation member corresponding to the circumferential air outlet.

Further, the semiconductor chilling and heating plate is connected with the electronic component through an electric wire, and a connecting passage for electric wire arrangement is formed inside the heat dissipation assembly.

Further, the heat dissipation assembly includes a connecting member, a connecting bracket is disposed at one end, close to the first housing, of the second housing, and the connecting member is clamped and connected with the connecting bracket.

Further, the connecting member is circumferentially provided with a protruding clamping strip, a mounting opening is formed in a middle portion of the connecting bracket, and a wall surface of the mounting opening is provided with a clamping hook clamped and connected with the clamping strip corresponding to the clamping strip.

Further, the connecting member is circumferentially provided with a positioning block, and the mounting opening is provided with a positioning groove adapted to the positioning block corresponding to the positioning block.

Further, the air channel includes a first air channel and a second air channel, the electronic component includes a battery and a mounting frame, the mounting frame is disposed on one side of the inner wall of the housing, and the battery is fixed on the mounting frame; and the first air channel is formed by a gap between the battery and the other side of the inner wall of the housing, and the second air channel is formed by a gap between the mounting frame and an adjacent inner wall of the housing.

Further, the heat dissipation assembly includes a heat dissipation fan, the heat dissipation fan comprises a supporting column and heat dissipation fins, and the supporting column is circumferentially provided with a plurality of heat dissipation fins; and the supporting column is opposite to the battery in a length direction of the housing.

The present disclosure has the beneficial effects that by means of the design of the air inlet of the housing, the air channel inside the housing, the heat dissipation assembly, and the circumferential air outlet, the heat dissipation performance of a product is improved. The circumferential air outlet ensures sufficient air output, such that heat exchanged between the heat dissipation assembly and the semiconductor chilling and heating plate can be carried away uniformly and quickly, and different orientations of the circumferential air outlet and a working end at one end of the housing provided with the semiconductor chilling and heating plate cannot cause interference to a nursed part when in use.

The first housing is connected with the second housing through the heat dissipation assembly, and the circumferential air outlet for air circulation in the heat dissipation assembly is correspondingly formed at a gap between the first housing and the second housing, without the need for secondary machining of the air outlet in the same housing. The separate design of the first housing and the second housing can facilitate the maintenance and replacement of the semiconductor chilling and heating plate, and allow for better maintainability and replaceability; meanwhile, the circumferential air outlet enables the heat dissipation assembly to be partially exposed, such that the heat dissipation assembly directly exchanges heat with the outside simultaneously while being taken as an appearance decoration, so as to improve the heat dissipation efficiency.

DETAILED DESCRIPTION OF THE EMBODIMENTS

Figure 1:
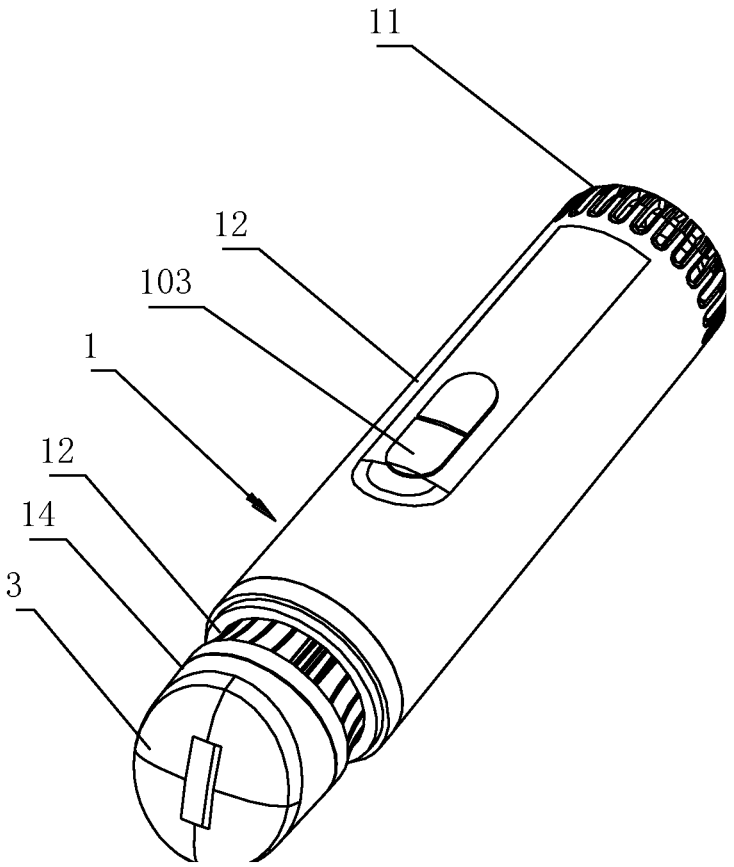
FIG. 1 is a schematic structural view of a cosmetology instrument according to a specific embodiment of the present disclosure.

In order to explain the technical contents, objects and effects of the present disclosure in detail, the embodiments will be described below with reference to the accompanying drawings.

Referring to FIG. 1 to FIG. 6, a cosmetology instrument includes a housing 1, a heat dissipation assembly, a semiconductor chilling and heating plate 2, and an electronic component. The housing 1 includes a first housing 13 and a second housing 14, the electronic component and the heat dissipation assembly are disposed in the first housing 13, the semiconductor chilling and heating plate 2 is disposed in the second housing 14, and the first housing 13 is connected with the second housing 14 through the heat dissipation assembly; a circumferential air outlet 12 is formed by a gap between the first housing 13 and the second housing 14, and the first housing 13 is provided with an air inlet 11; and an air channel communicated with the circumferential air outlet 12 and the air inlet 11 is formed between the electronic component and an inner wall of the housing 1.

It can be seen from the above description that the present disclosure has the beneficial effects that by means of the design of the air inlet 11 of the housing 1, the air channel inside the housing 1, the heat dissipation assembly, and the circumferential air outlet 12, the heat dissipation performance of a product is improved. The circumferential air outlet 12 ensures sufficient air output, such that heat exchanged between the heat dissipation assembly and the semiconductor chilling and heating plate 2 can be carried away uniformly and quickly, and different orientations of the circumferential air outlet 12 and a working end at one end of the housing 1 provided with the semiconductor chilling and heating plate 2 cannot cause interference to a nursed part when in use.

The first housing 13 is connected with the second housing 14 through the heat dissipation assembly, and the circumferential air outlet 12 for air circulation in the heat dissipation assembly is correspondingly formed at a gap between the first housing 13 and the second housing 14, without the need for secondary machining of the air outlet in the same housing 1. The separate design of the first housing 13 and the second housing 14 can facilitate the maintenance and replacement of the semiconductor chilling and heating plate 2, and allow for better maintainability and replaceability; meanwhile, the circumferential air outlet 12 enables the heat dissipation assembly to be partially exposed, such that the heat dissipation assembly directly exchanges heat with the outside simultaneously while being taken as an appearance decoration, so as to improve the heat dissipation efficiency.

Further, the heat dissipation assembly includes a heat dissipation fan 4 and a heat dissipation member 5, one end of the heat dissipation member 5 is connected with the semiconductor chilling and heating plate 2, the heat dissipation fan 4 is disposed on one side, away from the semiconductor chilling and heating plate 2, of the heat dissipation member 5, and the heat dissipation fan 4 is connected with the electronic component.

It can be seen from the above description that the heat dissipation assembly includes the heat dissipation fan 4 for actively dissipating heat and the heat dissipation member 5 for exchanging heat with the semiconductor chilling and heating plate 2.

Further, a guide cambered surface obliquely facing the circumferential air outlet 12 is disposed at a position on the heat dissipation member 5 corresponding to the circumferential air outlet 12.

It can be seen from the above description that by means of the design of the guide cambered surface, air sucked by the heat dissipation fan 4 from the air inlet 11 can be smoothly discharged from the heat dissipation member 5, so as to reduce the resistance to the flow of the air.

Further, the semiconductor chilling and heating plate 2 is connected with the electronic component through an electric wire, and a connecting passage 51 for electric wire arrangement is formed inside the heat dissipation assembly.

It can be seen from the above description that the concealed arrangement of electric wires of the semiconductor chilling and heating plate 2 and the electronic component is ensured by the connecting passage 51 designed in the heat dissipation assembly.

Further, the heat dissipation assembly includes a connecting member 6, a connecting bracket 141 is disposed at one end, close to the first housing 13, of the second housing 14, and the connecting member 6 is clamped and connected with the connecting bracket 141.

It can be seen from the above description that by clamping and connecting the connecting member 6 of the heat dissipation assembly with the connecting bracket 141 of the second housing 14, the quick connection of the first housing 13 and the second housing 14 is achieved.

Further, the connecting member 6 is circumferentially provided with a protruding clamping strip 61, a mounting opening is formed in a middle portion of the connecting bracket 141, and a wall surface of the mounting opening is provided with a clamping hook 142 clamped and connected with the clamping strip 61 corresponding to the clamping strip 61.

It can be seen from the above description that by matching the clamping strip 61 of the connecting member 6 with the clamping hook 142 on the mounting opening of the connecting bracket 141, the connecting member 6 is quickly clamped and connected with the connecting bracket 141.

Further, the connecting member 6 is circumferentially provided with a positioning block 62, and the mounting opening is provided with a positioning groove 143 adapted to the positioning block 62 corresponding to the positioning block 62.

It can be seen from the above description that by matching the positioning block 62 on the connecting member 6 with the positioning groove 143 in the mounting opening, the connecting member 6 and the mounting opening can be quickly positioned when the two are assembled.

Further, the air channel includes a first air channel 7 and a second air channel 8, the electronic component includes a battery 9 and a mounting frame 10, the mounting frame 10 is disposed on one side of the inner wall of the housing 1, and the battery 9 is fixed on the mounting frame 10; and the first air channel 7 is formed by a gap between the battery 9 and the other side of the inner wall of the housing 1, and the second air channel 8 is formed by a gap between the mounting frame 10 and an adjacent inner wall of the housing 1.

It can be seen from the above description that by means of the arrangement of the first air channel 7 and the second air channel 8, sufficient external air can flow into the heat dissipation assembly, and the heat dissipation assembly can uniformly contact with the air, thereby improving the heat dissipation effect.

Further, the heat dissipation assembly includes a heat dissipation fan 4, the heat dissipation fan 4 includes a supporting column 41 and heat dissipation fins 42, and the supporting column 41 is circumferentially provided with a plurality of heat dissipation fins 42; and the supporting column 41 is opposite to the battery 9 in a length direction of the housing 1.

It can be seen from the above description that the design of the supporting column 41 of the heat dissipation fan 4 opposite to the battery 9 ensures that the arrangement of the battery 9 in the length direction of the housing 1 cannot interfere with air suction of the heat dissipation fan 4, and the first air channel 7 and the second air channel 8 are reserved to be directly opposite to the heat dissipation fins 42.

Example 1

Application scenario: in terms of the design of a heat dissipation structure of an existing cosmetology instrument, an air inlet 11 and an air outlet for heat dissipation designed in the body of the product are usually formed in a single side surface of a shell, and uniform heat exchange of a heat dissipation assembly inside the body is limited by air output on a single side; and in view of the hand-held situation, the air inlet 11 designed in the side surface of a part of the bodies may be blocked by a hand for holding, such that the heat dissipation effect is not good, and the experience of a user is affected.

Figure 2:
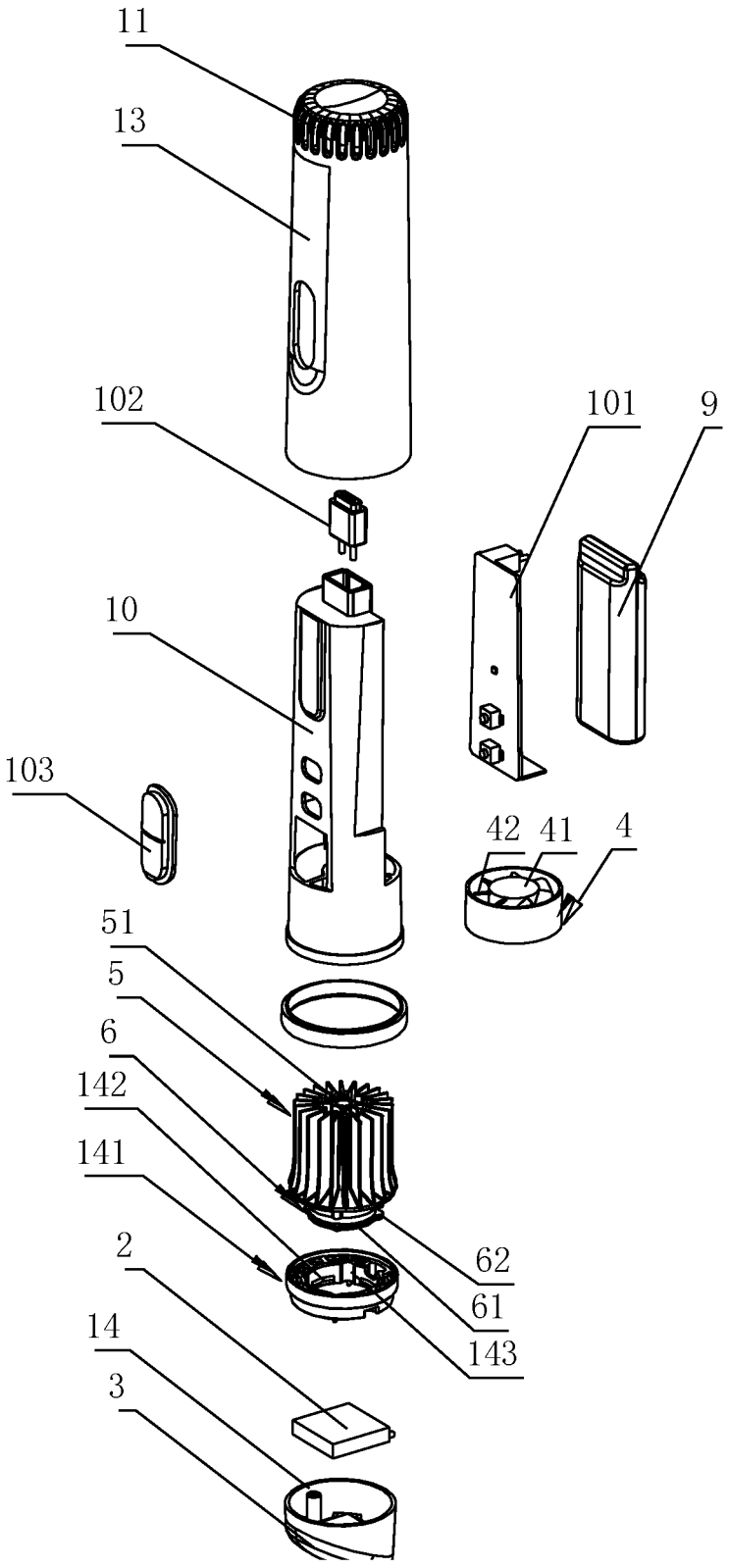
FIG. 2 is an exploded view of the cosmetology instrument according to a specific embodiment of the present disclosure.
Figure 3:
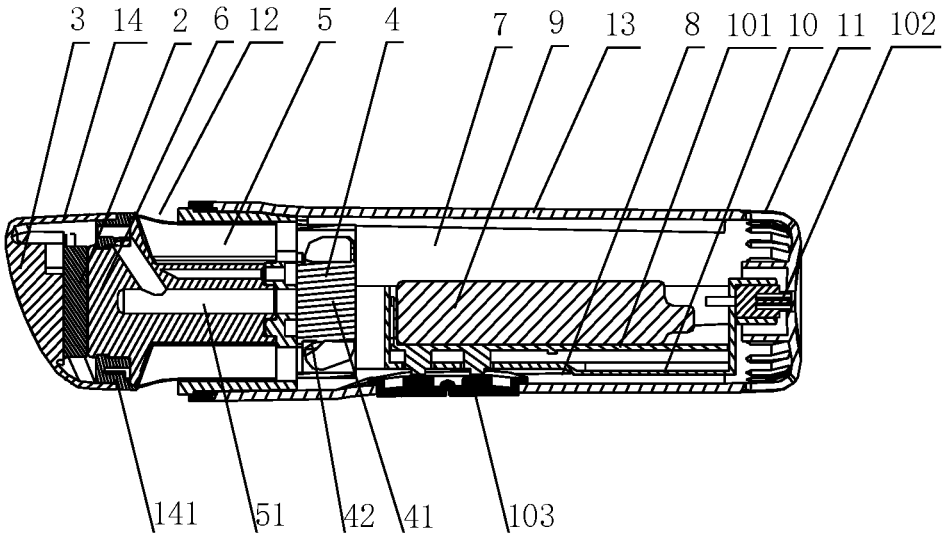
FIG. 3 is a cross-sectional view of the cosmetology instrument according to a specific embodiment of the present disclosure.

As shown in FIG. 1 to FIG. 3, the cosmetology instrument of this example includes a housing 1, a heat dissipation assembly, a semiconductor chilling and heating plate 2, and an electronic component. The heat dissipation assembly and the semiconductor chilling and heating plate 2 are both connected with the electronic component.

As shown in FIG. 1 to FIG. 3, one end of the housing 1 in a length direction is a working end, and the other end is provided with an air inlet 11. The working end is provided with a chilling and heating conductor 3 for contacting a human body and the semiconductor chilling and heating plate 2 for adjusting a temperature of the chilling and heating conductor 3, the heat dissipation assembly and the electronic component are sequentially disposed inside a middle section of the housing 1, and an air channel is formed between the electronic component and an inner wall of the housing 1. The heat dissipation assembly contacts with the semiconductor chilling and heating plate 2. A peripheral surface of the housing 1 is provided with a circumferential air outlet 12 corresponding to the heat dissipation assembly. The air channel is communicated with the air inlet 11 and the circumferential air outlet 12.

The working principle of the present disclosure is as follows: the product enables external air to reach the heat dissipation assembly through the air inlet 11 positioned at a tail end of the housing 1, working heat exchanged between the heat dissipation assembly and the semiconductor chilling and heating plate 2 is carried away, and the working heat is discharged from the circumferential air outlet 12 at the earliest. A gap between the electronic component and the inner wall of the housing 1 is designed to form the air channel, an internal space of the housing 1 is reasonably planned, and when the external air flows, part of the working heat of the electronic component can be carried away simultaneously, so as to ensure the heat dissipation effect when the product is used.

Moreover, the design of the circumferential air outlet 12 and the air inlet 11 at the end of the housing 1 also avoids the situation that the air inlet 11 is blocked by a hand of an operator holding the product when the air inlet 11 is formed in the peripheral surface of the housing 1 according to a hand-held state of the operator, while on the one hand, the circumferential air outlet 12 at the working end increases the air output and enhances the heat exchange between the air and the heat dissipation assembly, and on the other hand, considering that the air inlet 11 away from a hand-held part of the operator cannot be blocked when the operator holds the product, and is in a different direction from the working end, a nursed part cannot be affected.

Example 2

The difference between Example 1 and Example 2 is as follows: as shown in FIG. 1 to FIG. 4, the heat dissipation assembly includes a heat dissipation fan 4 and a heat dissipation member 5, one end of the heat dissipation member 5 is connected with the semiconductor chilling and heating plate 2, the heat dissipation fan 4 is disposed on one side, away from the semiconductor chilling and heating plate 2, of the heat dissipation member 5, and the heat dissipation fan 4 is connected with the electronic component.

Figure 5:
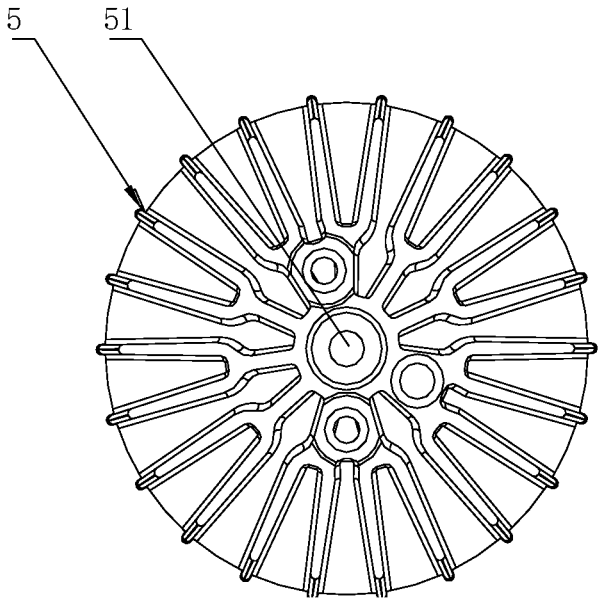
FIG. 5 is a top view of the heat dissipation member of the cosmetology instrument according to a specific embodiment of the present disclosure.

As shown in FIG. 5, the heat dissipation member 5 is circumferentially provided with a plurality of heat dissipation fins along a center of the heat dissipation member 5, and heat dissipation passages are formed among the heat dissipation fins.

A guide cambered surface obliquely facing the circumferential air outlet 12 is disposed at a position on the heat dissipation member 5 corresponding to the circumferential air outlet 12, and correspondingly, one end of each heat dissipation fin is arc-shaped to be matched with the guide cambered surface.

By means of the design of the guide cambered surface, air sucked by the heat dissipation fan 4 from the air inlet 11 can be smoothly discharged from the heat dissipation passages, so as to reduce the resistance to the flow of the air.

Example 3

Figure 6:
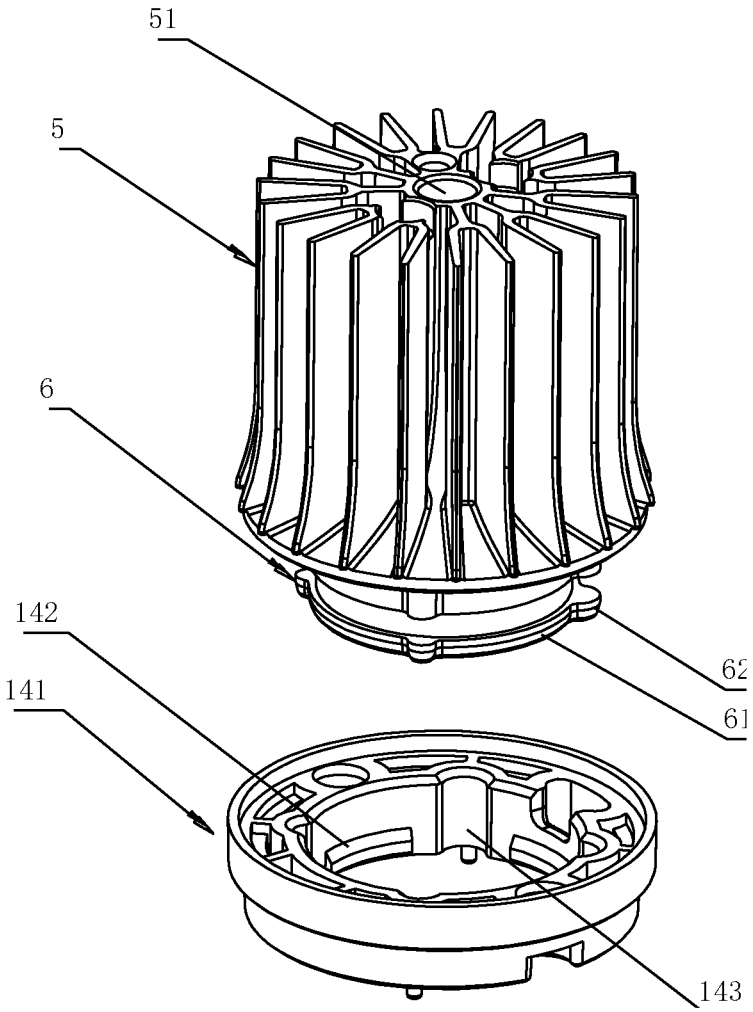
FIG. 6 is a schematic structural view of the heat dissipation member, the connecting member, and the connecting bracket of the cosmetology instrument according to a specific embodiment of the present disclosure.

The difference between Example 3 and Example 1 is as follows: as shown in FIG. 2 and FIG. 6, the housing 1 includes a first housing 13 and a second housing 14, the electronic component and the heat dissipation assembly are disposed in the first housing 13, the semiconductor chilling and heating plate 2 is disposed in the second housing 14, and the first housing 13 is connected with the second housing 14 through the heat dissipation assembly; and a circumferential air outlet 12 is formed by a gap between the first housing 13 and the second housing 14, the heat dissipation assembly includes a heat dissipation member 5 and a connecting member 6, one end, close to the semiconductor chilling and heating plate 2, of the heat dissipation member 5 is connected with the connecting member 6, and heat of the semiconductor chilling and heating plate 2 is transferred to the heat dissipation member 5 by the connecting member 6.

As shown in FIG. 6, specifically, the connection between the first housing 13 and the second housing 14 is achieved by matching the connecting member 6 of the heat dissipation assembly with a connecting bracket 141 disposed at one end of the second housing 14. The connecting member 6 is circumferentially provided with a protruding clamping strip 61, a mounting opening is formed in a middle portion of the connecting bracket 141, and a wall surface of the mounting opening is provided with a clamping hook 142 clamped and connected with the clamping strip 61 corresponding to the clamping strip 61. The connecting member 6 is circumferentially provided with a positioning block 62, and the mounting opening is provided with a positioning groove 143 adapted to the positioning block 62 corresponding to the positioning block 62. Optionally, the clamping strip 61 and the positioning block 62 may be disposed at the mounting opening of the connecting bracket 141, the corresponding clamping hook 142 and the positioning groove 143 may be disposed at the connecting member 6, and the arrangement is selected according to the actual process flow.

The connecting bracket 141 at one end of the second housing 14 may be of a structure integrally molded with the second housing 14 or a structure buckled and matched with the second housing 14.

Figure 4:
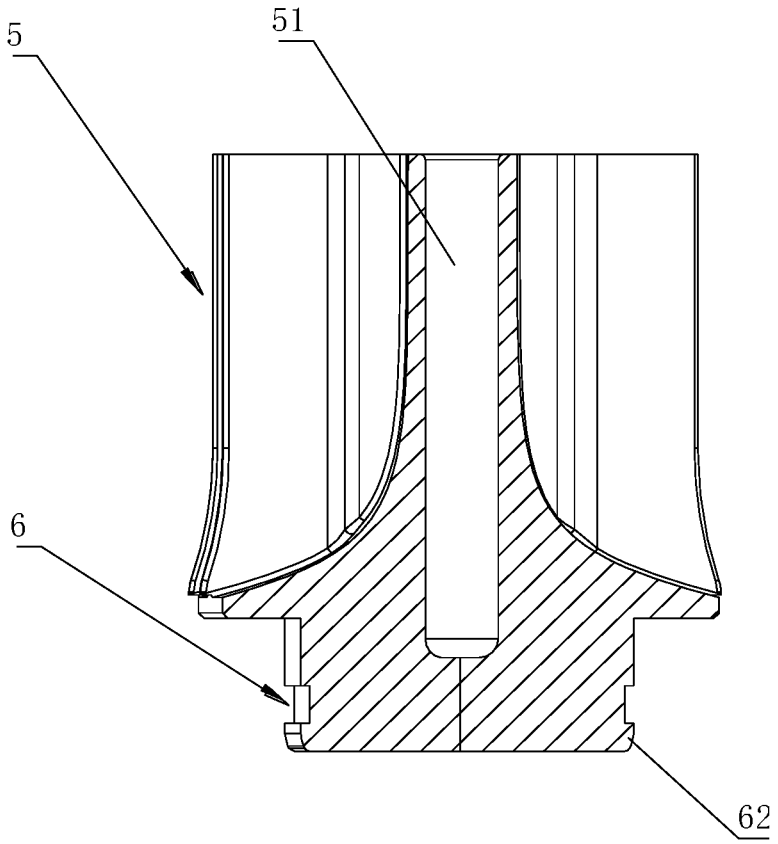
FIG. 4 is a cross-sectional view of a heat dissipation member and a connecting member of the cosmetology instrument according to a specific embodiment of the present disclosure.

As shown in FIG. 3 and FIG. 4, correspondingly the semiconductor chilling and heating plate 2 positioned in the second housing 14 is connected with the electronic component through an electric wire, while the electric wire is arranged in a connecting passage 51 formed in a middle portion of the heat dissipation member 5. One end of the electric wire extends from a connecting end of the electronic component and penetrates into the connecting passage 51 in the middle portion of the heat dissipation member 5, then penetrates out of a position on the heat dissipation member 5 close to the second housing 14, and is connected with the semiconductor chilling and heating plate 2 through a through hole correspondingly formed in the connecting bracket 141.

Example 4

The difference between Example 4 and Example 1 is as follows: as shown in FIG. 3, the air channel includes a first air channel 7 and a second air channel 8, the electronic component includes a battery 9 and a mounting frame 10, the mounting frame 10 is disposed on one side of the inner wall of the housing 1, and the battery 9 is fixed on the mounting frame 10; and the first air channel 7 is formed by a gap between the battery 9 and the other side of the inner wall of the housing 1, and the second air channel 8 is formed by a gap between the mounting frame 10 and an adjacent inner wall of the housing 1. The heat dissipation assembly includes a heat dissipation fan 4, the heat dissipation fan 4 includes a supporting column 41 and heat dissipation fins 42, and the supporting column 41 is circumferentially provided with a plurality of heat dissipation fins 42; and the supporting column 41 is opposite to the battery 9 in a length direction of the housing 1. By means of the arrangement of the first air channel 7 and the second air channel 8, sufficient external air can flow into the heat dissipation assembly, and the heat dissipation assembly can uniformly contact with the air, thereby improving the heat dissipation effect; while the corresponding design of the supporting column 41 of the heat dissipation fan 4 opposite to the battery 9 ensures that the arrangement of the battery 9 in the length direction of the housing 1 cannot interfere with air suction of the heat dissipation fan 4, and the first air channel 7 and the second air channel 8 are reserved to be directly opposite to the heat dissipation fins 42.

Example 5

As shown in FIG. 1 to FIG. 6, the cosmetology instrument of this example includes a housing 1, a heat dissipation assembly, a semiconductor chilling and heating plate 2, and an electronic component. The heat dissipation assembly and the semiconductor chilling and heating plate 2 are both connected with the electronic component.

As shown in FIG. 2 and FIG. 3, the housing 1 includes a first housing 13 and a second housing 14, the electronic component and the heat dissipation assembly are disposed in the first housing 13, the semiconductor chilling and heating plate 2 is disposed in the second housing 14, and the first housing 13 is connected with the second housing 14 through the heat dissipation assembly. One end, away from the second housing 14, of the first housing 13 is provided with an air inlet 11, and a circumferential air outlet 12 is formed by a gap between the first housing 13 and the second housing 14.

As shown in FIG. 1, the first housing 13 serves as a hand-held part for an operator to use, one end, away from the first housing 13, of the second housing 14 is provided with a chilling and heating conductor 3, and the chilling and heating conductor 3 serves as a working part in direct contact with a human body and is connected with the semiconductor chilling and heating plate 2.

As shown in FIG. 2 and FIG. 4, the heat dissipation assembly includes a heat dissipation member 5, a heat dissipation fan 4, and a connecting member 6, one end, close to the semiconductor chilling and heating plate 2, of the heat dissipation member 5 is connected with the connecting member 6, and heat of the semiconductor chilling and heating plate 2 is transferred to the heat dissipation member 5 by the connecting member 6. The heat dissipation fan 4 is disposed on one side, away from the semiconductor chilling and heating plate 2, of the heat dissipation member 5, and the heat dissipation fan 4 is electrically connected with the electronic component. The heat dissipation fan 4 includes a supporting column 41 and heat dissipation fins 42, and the supporting column 41 is circumferentially provided with a plurality of heat dissipation fins 42.

As shown in FIG. 3 to FIG. 5, a guide cambered surface obliquely facing the circumferential air outlet 12 is disposed at a position on the heat dissipation member 5 corresponding to the circumferential air outlet 12. The heat dissipation member 5 is circumferentially provided with a plurality of heat dissipation fins along a center of the heat dissipation member 5, and heat dissipation passages are formed among the heat dissipation fins. Specifically, the cross section of each heat dissipation fin is Y-shaped, such that the heat dissipation effect is improved by an irregular cross section design.

As shown in FIG. 2 and FIG. 6, specifically, the connection between the first housing 13 and the second housing 14 is achieved by matching the connecting member 6 of the heat dissipation assembly with a connecting bracket 141 disposed at one end of the second housing 14. The connecting member 6 is circumferentially provided with a protruding clamping strip 61, a mounting opening is formed in a middle portion of the connecting bracket 141, and a wall surface of the mounting opening is provided with a clamping hook 142 clamped and connected with the clamping strip 61 corresponding to the clamping strip 61. The connecting member 6 is circumferentially provided with a positioning block 62, and the mounting opening is provided with a positioning groove 143 adapted to the positioning block 62 corresponding to the positioning block 62. Optionally, the clamping strip 61 and the positioning block 62 may be disposed at the mounting opening of the connecting bracket 141, the corresponding clamping hook 142 and the positioning groove 143 may be disposed at the connecting member 6, and the arrangement is selected according to the actual process flow.

The connecting bracket 141 at one end of the second housing 14 may be of a structure integrally molded with the second housing 14 or a structure buckled and matched with the second housing 14.

As shown in FIG. 3, correspondingly the semiconductor chilling and heating plate 2 positioned in the second housing 14 is connected with the electronic component through an electric wire, while the electric wire is arranged in a connecting passage 51 formed in a middle portion of the heat dissipation member 5 and in the supporting column 41 of the heat dissipation fan 4. One end of the electric wire extends from a connecting end of the electronic component and penetrates into the supporting column 41 of the heat dissipation fan 4 and the connecting passage 51 in the middle portion of the heat dissipation member 5, then penetrates out of a position on the heat dissipation member 5 close to the second housing 14, and is connected with the semiconductor chilling and heating plate 2 through a through hole correspondingly formed in the connecting bracket 141.

A first air channel 7 and a second air channel 8 are formed between the first housing 13 and a power supply assembly disposed inside the first housing 13. Specifically, the electronic component includes a battery 9, a control circuit board 101, a mounting frame 10, and a Type-C charging interface 102. The mounting frame 10 is disposed on one side of the inner wall of the housing 1, the battery 9 and the control circuit board 101 are fixed on the mounting frame 10, and the Type-C charging interface 102 is formed in the air inlet 11 to be connected with the battery 9. The first air channel 7 is formed by a gap between the battery 9 and the other side of the inner wall of the housing 1, and the second air channel 8 is formed by a gap between the mounting frame 10 and an adjacent inner wall of the housing 1.

A key 103 is disposed on a side surface of the first housing 13 to be connected with the control circuit board 101, so as to adjust working gears of the product and the like.

The supporting column 41 of the heat dissipation fan 4 is opposite to the battery 9 in a length direction of the housing 1, while the heat dissipation fins 42 of the heat dissipation fan 4 are opposite to the first air channel 7 and the second air channel 8, respectively.

In summary, for the cosmetology instrument provided by the present disclosure, by means of the design of the air inlet at the end of the housing, the air channel inside the housing, the heat dissipation assembly, and the circumferential air outlet, the heat dissipation performance of a product is improved. The circumferential air outlet ensures sufficient air output, such that heat exchanged between the heat dissipation assembly and the semiconductor chilling and heating plate can be carried away uniformly and quickly, and different orientations of the circumferential air outlet and a working end at one end of the housing provided with the semiconductor chilling and heating plate cannot cause interference to a nursed part when in use, while the design of the air inlet at the end of the housing enables the air inlet not to be blocked when the housing is held by a hand; and the first housing is connected with the second housing through the heat dissipation assembly, and the circumferential air outlet for air circulation in the heat dissipation assembly is correspondingly formed at a gap between the first housing and the second housing, without the need for secondary machining of the air outlet in the same housing. The separate design of the first housing and the second housing can facilitate the maintenance and replacement of the semiconductor chilling and heating plate, and allow for better maintainability and replaceability; meanwhile, the circumferential air outlet enables the heat dissipation assembly to be partially exposed, such that the heat dissipation assembly directly exchanges heat with the outside simultaneously while being taken as an appearance decoration, so as to improve the heat dissipation efficiency.

The foregoing is merely examples of the present disclosure, and does not therefore limit the patent scope of the present disclosure. All equivalent transformations made by using the contents of the description and accompanying drawings of the present disclosure, or directly or indirectly applied to the relevant technical fields, are similarly included in the patent protection scope of the present disclosure.

What is claimed is:

1. A cosmetology instrument, comprising a housing, a heat dissipation assembly, a semiconductor chilling and heating plate, and an electronic component, wherein the electronic component comprises a mounting frame, the housing comprises a first housing and a second housing, the electronic component and the heat dissipation assembly are disposed in the first housing, the mounting frame is disposed on the inner wall of the first housing, and the semiconductor chilling and heating plate is disposed in the second housing;

the heat dissipation assembly comprises a connecting member, a connecting bracket is disposed at one end, close to the first housing, of the second housing, the connecting member is clamped and connected with the connecting bracket, the first housing is connected with the heat dissipation assembly through the mounting frame in a non-contact manner, and the second housing is connected with the heat dissipation assembly through the connecting bracket in a non-contact manner;

a circumferential air outlet for air circulation in the heat dissipation assembly is correspondingly formed at a gap between the first housing and the second housing, the circumferential air outlet is bounded at one end by the end face of the connection bracket and at the other end by the end face of the mounting frame, and an air inlet is provided at an end portion of the first housing away from the second housing; and an air channel communicated with the circumferential air outlet and the air inlet is formed between the electronic component and an inner wall of the first housing.

2. The cosmetology instrument according to claim 1, wherein the heat dissipation assembly comprises a heat dissipation fan and a heat dissipation member, one end of the heat dissipation member is connected with the semiconductor chilling and heating plate, the heat dissipation fan is disposed on one side, away from the semiconductor chilling and heating plate, of the heat dissipation member, and the heat dissipation fan is connected with the electronic component.

3. The cosmetology instrument according to claim 2, wherein a guide cambered surface obliquely facing the circumferential air outlet is disposed at a position on the heat dissipation member corresponding to the circumferential air outlet.

4. The cosmetology instrument according to claim 1, wherein the semiconductor chilling and heating plate is connected with the electronic component through an electric wire, and a connecting passage for electric wire arrangement is formed inside the heat dissipation assembly.

5. The cosmetology instrument according to claim 1, wherein the connecting member is circumferentially provided with a protruding clamping strip, a mounting opening is formed in a middle portion of the connecting bracket, and a wall surface of the mounting opening is provided with a clamping hook clamped and connected with the clamping strip corresponding to the clamping strip.

6. The cosmetology instrument according to claim 5, wherein the connecting member is circumferentially provided with a positioning block, and the mounting opening is provided with a positioning groove adapted to the positioning block corresponding to the positioning block.

7. The cosmetology instrument according to claim 1, wherein the air channel comprises a first air channel and a second air channel, the electronic component further comprises a battery, and the battery is fixed on the mounting frame; and the first air channel is formed by a gap between the battery and the other side of the inner wall of the housing, and the second air channel is formed by a gap between the mounting frame and an adjacent inner wall of the housing.

8. The cosmetology instrument according to claim 7, wherein the heat dissipation assembly comprises a heat dissipation fan, the heat dissipation fan comprises a supporting column and heat dissipation fins, and the supporting column is circumferentially provided with a plurality of heat dissipation fins; and the supporting column is opposite to the battery in a length direction of the housing.

* * * * *